United States Patent [19]

Stamatiou et al.

[11] Patent Number: 5,018,235

[45] Date of Patent: May 28, 1991

[54] MAT HOLDER

[75] Inventors: Paul O. Stamatiou, Walderslade; Christopher R. Stevens, Maidstone, both of Great Britain

[73] Assignee: Kimberly-Clark Corporation, Neenah, Wis.

[21] Appl. No.: 406,337

[22] Filed: Sep. 12, 1989

[30] Foreign Application Priority Data

Sep. 13, 1988 [GB] United Kingdom ..... 8821407

[51] Int. Cl.[5] ..... B32B 3/00

[52] U.S. Cl. ..... 15/215; 15/231

[58] Field of Search ..... 248/632, 633, 634, 154, 248/205.2, 346; 15/215, 216, 217, 231; 16/7; 428/81, 82, 83, 74, 45

[56] References Cited

U.S. PATENT DOCUMENTS

| | | | |
|---|---|---|---|
| 918,396 | 4/1909 | Tracy . | |
| 1,633,951 | 6/1927 | O'Toole . | |
| 1,641,029 | 8/1927 | Gaudet . | |
| 2,187,676 | 1/1940 | Biewen | 4/252 |
| 2,644,977 | 7/1953 | June | 16/7 |
| 2,771,613 | 11/1956 | Markiewicz | 4/252 |
| 2,990,033 | 6/1961 | Arnold | 184/106 |
| 3,083,393 | 4/1963 | Nappi | 15/215 |
| 3,129,972 | 4/1964 | Vodra | 296/1 |
| 3,156,957 | 11/1964 | Moeckel | 20/78.3 |
| 3,158,962 | 12/1964 | Faase | 50/321 |
| 3,206,785 | 9/1965 | Heil | 15/215 |
| 3,238,554 | 3/1966 | Mann | 15/217 |
| 3,390,912 | 7/1968 | Stata | 296/1 |
| 3,400,421 | 9/1968 | Nappi | 15/215 |
| 3,415,300 | 12/1968 | Worcester | 248/205.2 |
| 3,435,480 | 4/1969 | Mann, Jr. | 15/215 |
| 3,445,083 | 5/1969 | Moss | 248/350 |
| 3,488,081 | 1/1970 | Nolen | 296/1 |
| 3,501,797 | 3/1970 | Nappi | 15/215 |
| 3,578,738 | 5/1971 | Hughes | 15/215 |
| 3,654,064 | 4/1972 | Laumann | 161/156 |
| 3,665,543 | 5/1972 | Nappi | 15/215 |
| 3,717,897 | 2/1973 | Amos et al. | 15/215 |
| 3,785,102 | 1/1974 | Amos | 52/173 |
| 3,856,610 | 12/1974 | Bruneel | 161/43 |
| 3,909,996 | 10/1975 | Ettlinger, Jr. | 52/177 |
| 4,029,834 | 6/1977 | Bartlett | 428/62 |
| 4,054,698 | 10/1977 | Hamrah | 428/40 |
| 4,125,656 | 11/1978 | Creamer | 428/80 |
| 4,143,194 | 3/1979 | Wihksne | 428/18 |
| 4,285,075 | 8/1981 | Nelson | 4/252 |
| 4,328,275 | 5/1982 | Vargo | 428/156 |
| 4,353,944 | 10/1982 | Tauri | 428/74 |
| 4,377,610 | 3/1983 | McClung | 428/88 |
| 4,421,809 | 12/1983 | Bish | 428/90 |
| 4,439,474 | 3/1984 | Sagel | 428/90 |
| 4,482,593 | 11/1984 | Sagel | 428/90 |
| 4,564,546 | 1/1986 | Jones | 428/81 |
| 4,609,580 | 9/1986 | Rockett | 428/198 |

FOREIGN PATENT DOCUMENTS

| | | | |
|---|---|---|---|
| 1171250 | 11/1969 | United Kingdom . | |
| 1213875 | 11/1970 | United Kingdom . | |
| 2065469A | 7/1981 | United Kingdom . | |
| 2083352 | 3/1982 | United Kingdom | 248/309.1 |

*Primary Examiner*—Ramon O. Ramirez
*Assistant Examiner*—Robert A. Olson
*Attorney, Agent, or Firm*—William D. Herrick

[57] ABSTRACT

A holder for flexible material, for example a disposable floor mat, comprises a base (4) on which the material (18) rests, at least part of the base having an integral wall (12) so arranged as to form a recess (6). The recess is dimensioned so as to receive the material in a close fit and means are provided to hold the material in place. The holding means may comprise a lip (14) integral with the wall of the holder which extends above the recess (16) and means (19) may be provided on the surface of the holder to act as a guide for the correct placement of the material (18). Additionally or alternatively the base (4) of the holder may include holding means (20,26), such as "Klettostop", which comprises a plurality of upwardly extending hooks or spikes formed from a plastic material. Means (26) may also be provided for retaining the holder (2) on a support surface.

8 Claims, 5 Drawing Sheets

MAT HOLDER

This invention relates to holders for flexible mats and in particular to holders for disposable floor mats. Disposable floor mats are not normally provided with gripping means on their bases, for example the rubber ribbing provided with some conventional bristle mats, and consequently holders are necessary which include means to prevent wrinkling and slipping of the mats. Moreover the holders have to be capable of firmly securing the disposable mats which are thinner than conventional bristle mats. However the holder also is desirably arranged so that the disposable mat can be readily removed and a fresh mat inserted.

The mat is of flexible material and suitably has at least two layers, the upper layer being an abrasion resistant layer and the other layer being an absorbent layer.

The abrasion resistant layer is usually made of non-woven filaments and is pervious to allow the water deposited on the surface of the mat to soak through to the absorbent layer. The absorbant layer usually consists of a mixture of polymeric microfibers and absorbent particles, such as wood pulp.

Such a mat is usually backed by a thin impervious layer, however the holder of the invention, which is moulded in one piece, obviates the need for such a layer.

The mat hereinafter referred to as "a mat of the type described", is usually only a few millimeters in depth and is flexible. Traditional holders, for bristle mats or the like, are therefore not suitable.

One type of holder which has been suggested has a flat base adapted to hold the mat and at least one hingeably connected side flap adapted to fold over an edge of the mat and grip it to securely maintain the mat in position.

However this type of holder requires a relatively complicated moulding procedure to produce the component parts and is therefore expensive to manufacture. Furthermore the hinges are susceptible to weakening over a period of time as the mats are replaced frequently.

In accordance with the invention a holder for a flexible mat comprises a base on which the material rests, at least part of the base having an integral wall so arranged as to form a recess dimensioned so as to receive the flexible mat, preferably in a close fit, means being provided to hold the edge portion of the material of the mat in place.

The base may be formed from either a flexible or rigid material, preferably rubber, rubber-like material such as SBR, Neoprene or Nitrile, or other plastic polymers, such as PVC.

Suitably at least part of the wall around the recess has an integral lip extending above the recess to form a channel into which the edge portion of the mat may extend to hold the mat in place. Preferably the channel is provided around the complete perimeter of the recess.

Means may be provided on the upper surface of the wall to act as a guide for the correct placement of the flexible material. This guide means is preferably a ridge which extends around the holder, vertically aligned with the edge of the recess.

This arrangement can be produced with a single mould and is therefore less expensive than known holders but is still capable of firmly holding the flexible material and preventing it from slipping or wrinkling.

Each corner of the holder may be provided with a slit which extends from the free edge of the lip to the wall of the base. This slit assists in the insertion of the flexible material into the recess of the holder.

A layer of resilient material may be provided between the flexible material and the base in which case the channel is preferably dimensioned so as to receive both an edge of the flexible material and an edge of the layer of resilient material. If the flexible material is in the form of a floor mat, the layer of resilient material makes the mat more comfortable to walk on.

Alternatively the holding means may comprise one side which can be secured to the base and a second side which has means for releasably attaching the fibrous portion of the flexible material thereto.

Preferably the holding means are attached to the flexible material at or adjacent at least one edge of the flexible material. Alternatively the holding means may extend across the whole area of the flexible material.

Preferably the holding means comprises part of the self bonding device known as "Klettostop". This comprises two portions a "male" portion and a "female" portion. The male portion has a surface with a very large number of spikes, which may be hooked, formed from a plastics material while the female portion has a surface with a large number of loops also formed from a plastics material. When the two surfaces are brought together the spikes or hooks latch onto the loops to connect the two portions. Separation is achieved by pulling the two portions firmly apart.

The holding means preferably comprises a male "Klettostop" portion since the spikes or hooks on this will attach it to nearly any fibrous surface. The other side of the male portion is preferably coated with an adhesive to allow it to be secured to the base of the holder.

Very preferably when the holding means is provided at or adjacent the edge of the flexible material the spikes are arranged to slant towards that edge. They therefore act as a tensioning device to keep the flexible material taut and stable.

A layer of resilient material may be provided between the base and part of those portions of the flexible material not attached to the base. In particular if the holding means are provided at the edge(s) of the flexible material then a layer of resilient material may be provided beneath the remainder of the flexible material intermediate the holding means. Suitably the thickness of the layer of flexible material is approximately equal to the distance between the two sides of the holding means. The layer of resilient material then serves to keep the height of the assembled arrangement constant, in particular it prevents a dip in the middle when the holding means are provided at the edges of the flexible material. Moreover, as noted above, however positioned, if the flexible material is in the form of a floor mat the resilient material serves to make this more comfortable to walk on. The resilient layer may be integral with the base.

The holder may comprise both the integral lip and the "Klettostop" in which case the flexible mat is doubly held in place and the resistance to slipping and wrinkling is high.

The holder may also have means for retaining its base in place on a support surface.

Suitably the retaining means comprises at least one holding means, one side of which can be secured to the base and the other side of which is removably attachable to a fibrous surface. This arrangement allows the base to be held in place on fibrous surface for example a carpet or fibrous mat floor. If the support surface is smooth then connection means are suitably provided, one side of which can be secured to the support surface. Preferably the connection means comprises a female "Klettostop" portion, the smooth side of which may be coated with adhesive and secured to the support surface.

As discussed above, in a preferred embodiment of this invention the flexible material is a disposable floor mat. Such mats are often provided with an impervious backing layer. The holder obviates the need for this layer.

Suitably the edges of the base are tapered, that is their thickness decreases from a maximum at or adjacent the part on which the edge of the flexible material rests to a minimum at the extreme outer edges. In particular if the base has a recess the walls are tapered towards the outside edge. This gives both greater safety, preventing catching on the edge of the base, and an attractive appearance.

The invention will now be further described by way of example with reference to the accompanying drawings in which.

Figure 1:
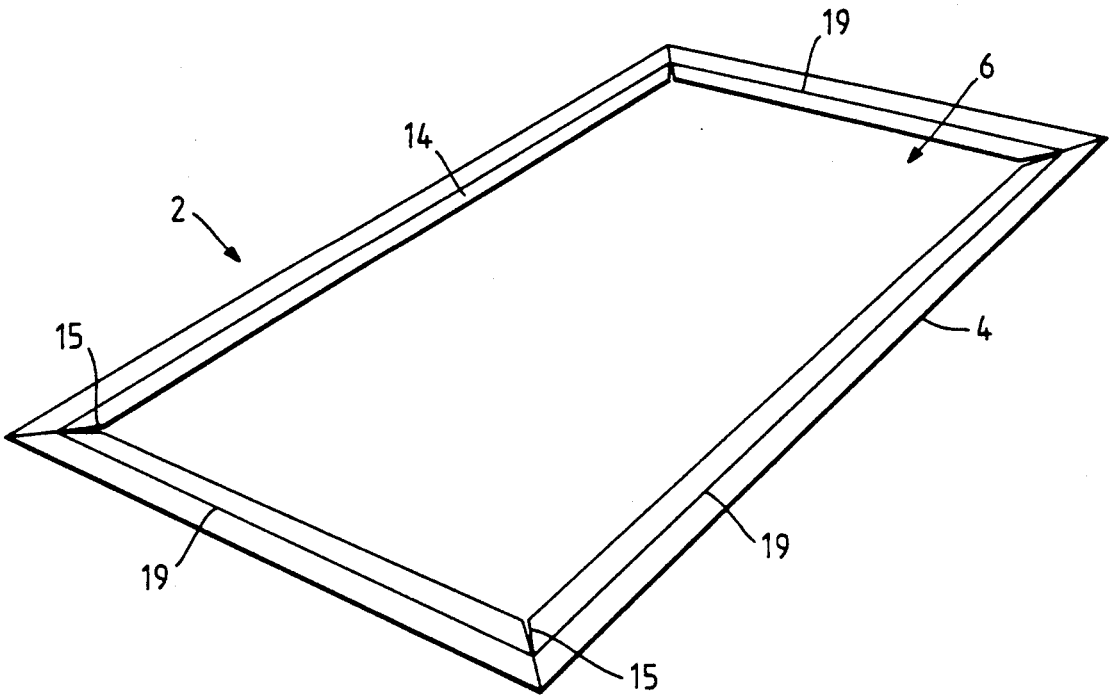
FIG. 1 is a plan view of a holder in accordance with one aspect of the invention.
Figure 2:
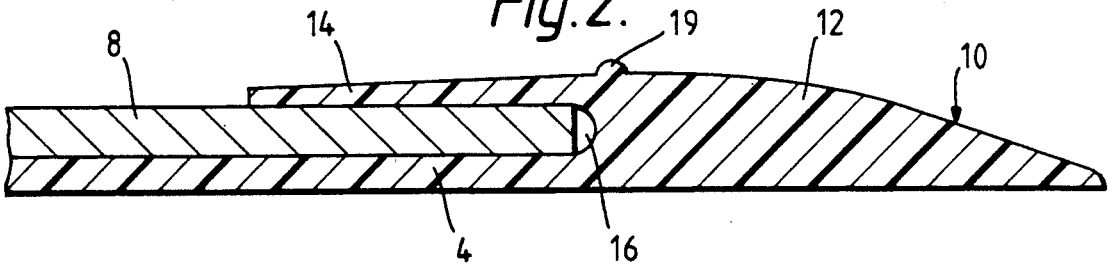
FIG. 2 is a section through part of one embodiment of the holder of FIG. 1.
Figure 3:
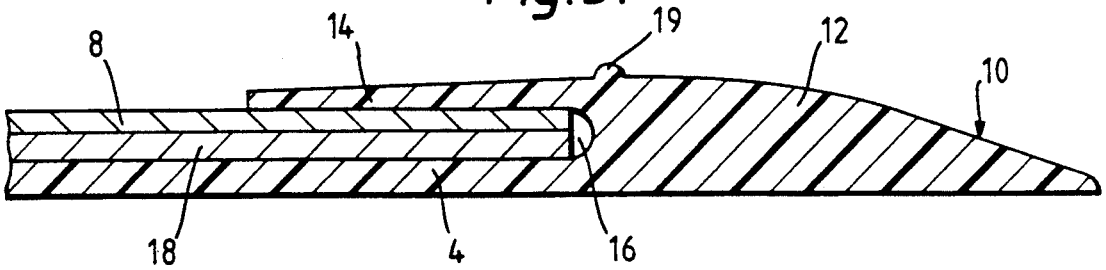
FIG. 3 is a similar view to FIG. 2 showing a second embodiment.

The holder 2 shown in the drawings comprises a base 4 with a recess 6 in which a mat of flexible material 8 (shown in the sectional views), preferably a disposable floor mat, rests. The base 4 is formed from flexible or rigid plastics, rubber or rubber-like material.

The walls 12 of the base 4 have a tapered edge 10. Thus the walls 12 around the recess 6 have a smooth edge and no sharp points which make them safer and gives the base an attractive appearance.

The walls 12 of the base 4 have integral extensions in the form of lips 14, to provide a channel 16 along each edge. The channels 16 are dimensioned so as to receive the edges of mat 8 in a close fit to hold the mat 8 in place on the base 4. Additionally a layer of resilient material 18 may be provided between the mat 8 and the base 4 to make the mat 8 more comfortable to walk on, in which case the channel 16 is dimensioned to receive the edge of both the mat 8 and the resilient layer 18.

The lips 14 allow the mat to be firmly held in place and easily removed but are not weakened by removal of the mat as are the hinged flaps in known holders.

As shown in FIG. 1 a ridge 19 extends around the holder and acts as a guide for the placement of the flexible mat 8. The lips 14 are provided with slits 15 at the corners of the holders so that the lips 14 may be lifted up and the mat 8 inserted into the recess 6.

In order to insert the flexible mat 8 into the holder 2 the mat is first placed on the holder such that the edges of the mat 8 lie adjacent to the ridge 19. The edges 10 of the holder are then bent towards the base 4. This causes the lips 14 to be forced upwards, so exposing the whole recess 6. The edges of the flexible mat 8 are then eased into the recess, the now upwardly extending lips 14 forming a backstop against which the mat abuts. The edges 10 of the holder are then released and the lips 14 descend to overlap the edges of the mat 8.

Figure 4:
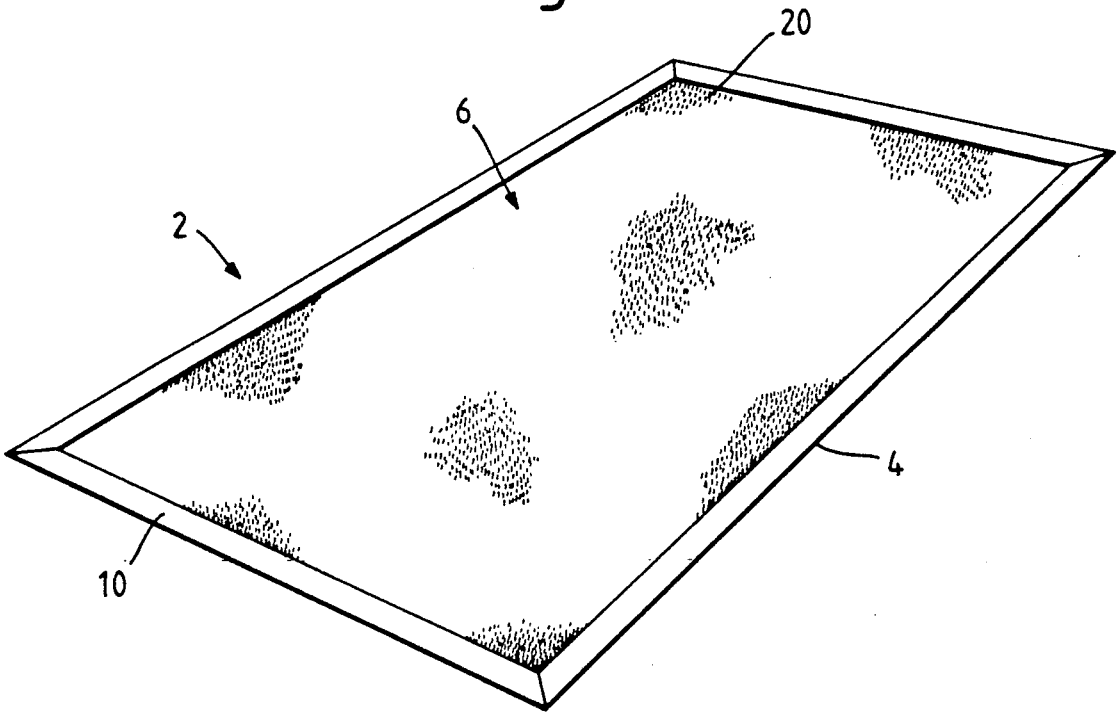
FIG. 4 is a plan view of one embodiment of a holder in accordance with another aspect of the invention.
Figure 5:
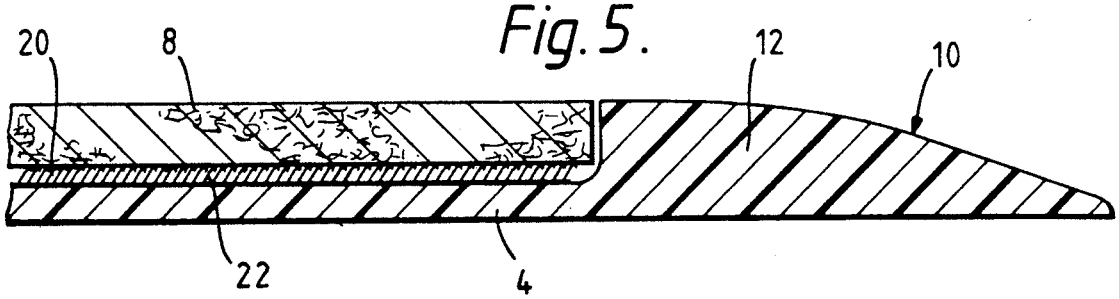
FIG. 5 is a section through part of the holder of FIG. 4.
Figure 6:
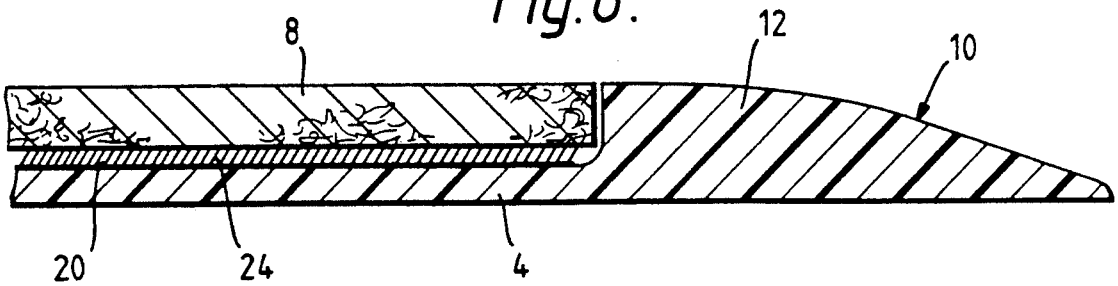
FIG. 6 is a section through an alternative form of the holder of FIG. 4.

A different way of holding the mat 8 in place is illustrated in FIGS. 4 to 6. A pad of 'Klettostop' 20 is stuck to the bottom of the recess 6 by adhesive. The pad 20 is "male" in that it has upwardly extending hooks 22 (FIGS. 5) or spikes 24 (FIG. 6). This type of holder is used with a mat which has at least a layer of fibrous material, for example a mat comprising two layers of spunbonded polymeric material which sandwich a layer of a polymeric microfiber web as described in our European Patent Application No. 0245933. The hooks 22 or spikes 24 catch the fibers and hold the mat in place.

When spikes 24 are used they are preferably arranged to slant at least at the edges of the pad 20 towards the edges of the base 4. The spikes 24 then serve as a tensioning device and increase the ability of the arrangement to keep the mat taut and stable.

Figure 7:
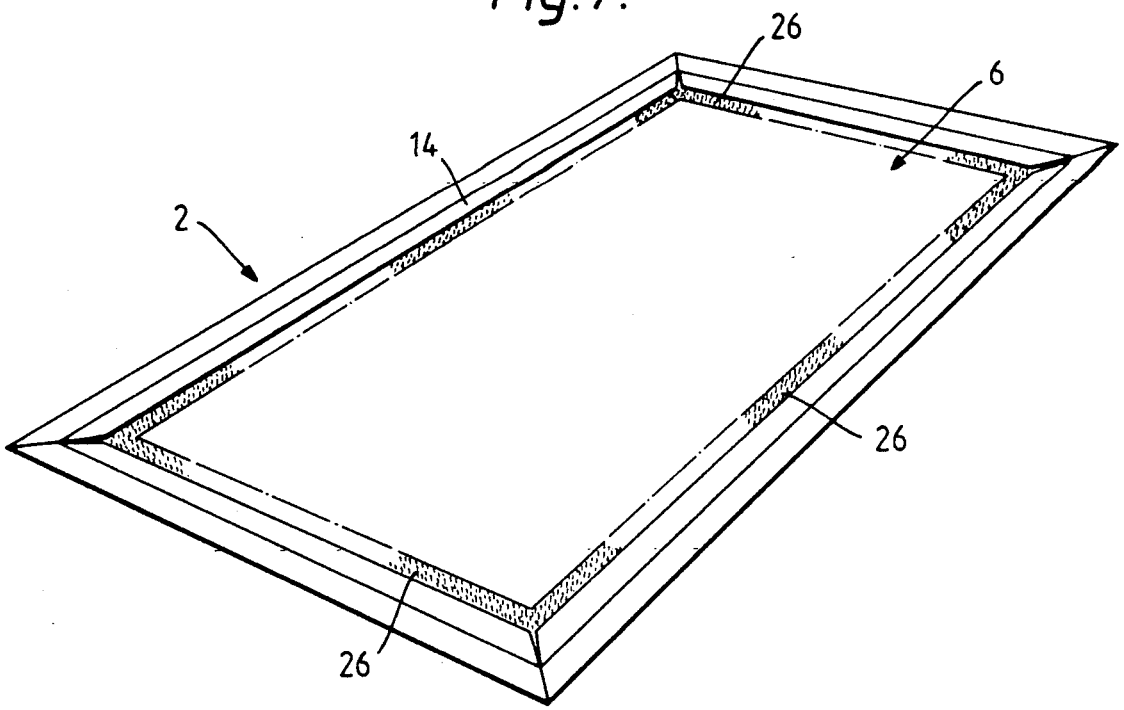
FIG. 7 is a plan view of a second embodiment of the holder of FIG. 4.
Figure 8:
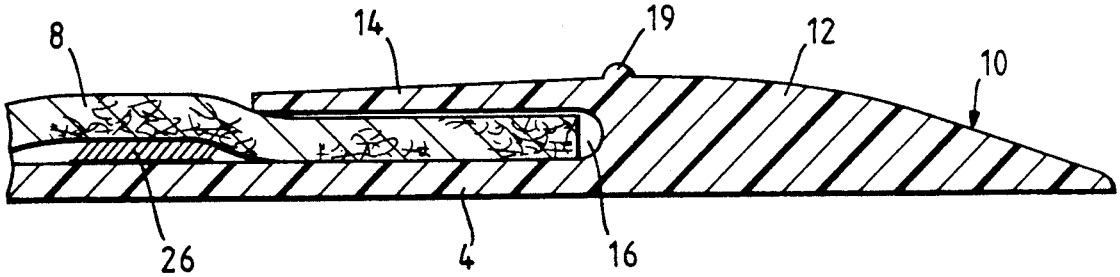
FIG. 8 is a section through part of the holder of FIG. 7.

In the holder shown in FIGS. 7 and 8, strips 26 of 'Klettostop' are provided, the spikes of which again preferably slant towards the appropriate edge. The walls 12 of the holder have integral lips 14 so that channels 16 are provided for the edges of the mat. The mat 8 is therefore doubly held in place. The strips 26 of Velcro are positioned adjacent the edge of the mat 8 to be caught under the lip 14.

The lips 14 by themselves or the strips 26 by themselves are sufficient to hold the mat in place but together they combine to give a very firm retention of the mat.

Figure 9:
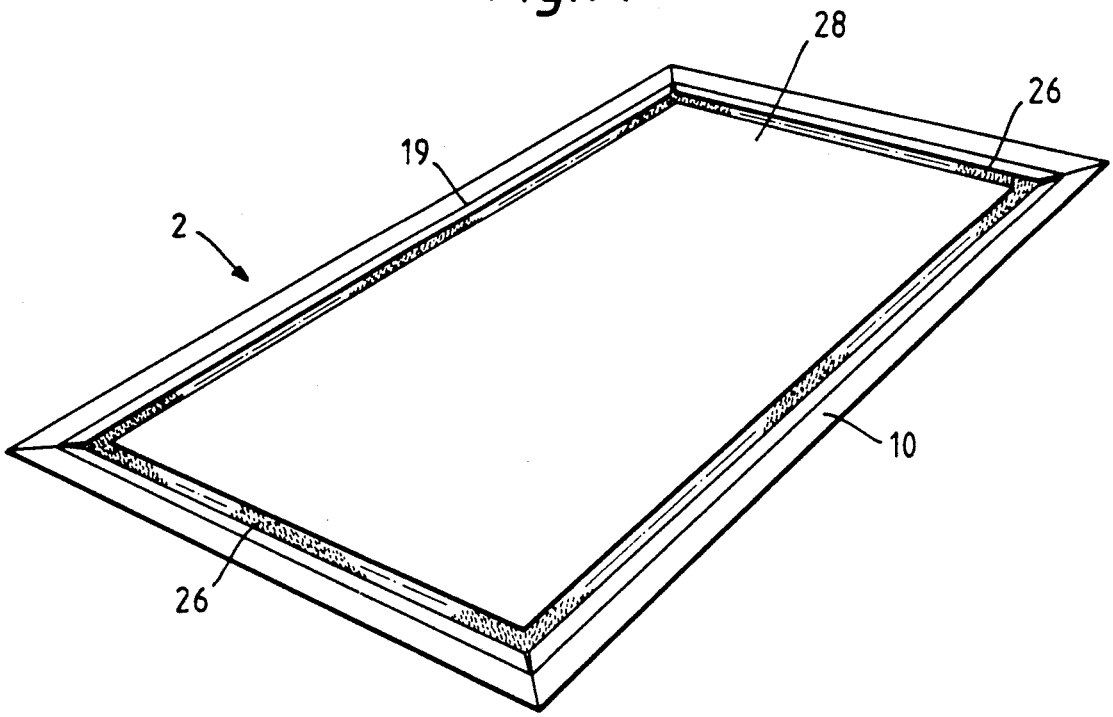
FIG. 9 is a plan view of a third embodiment of the holder of FIG. 4.
Figure 10:
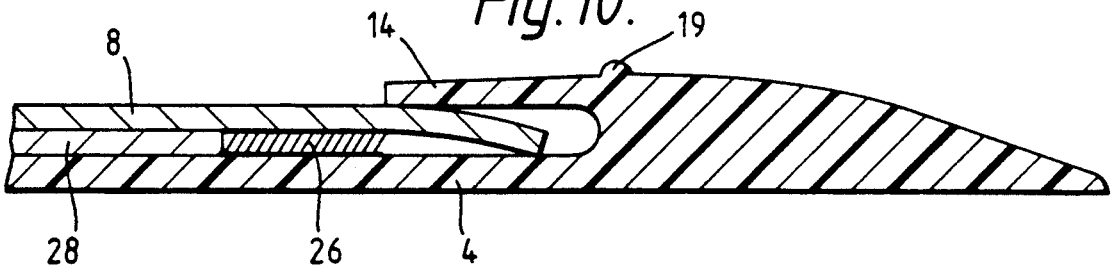
FIG. 10 is a sectional view of part of the holder of FIG. 9.
Figure 11:
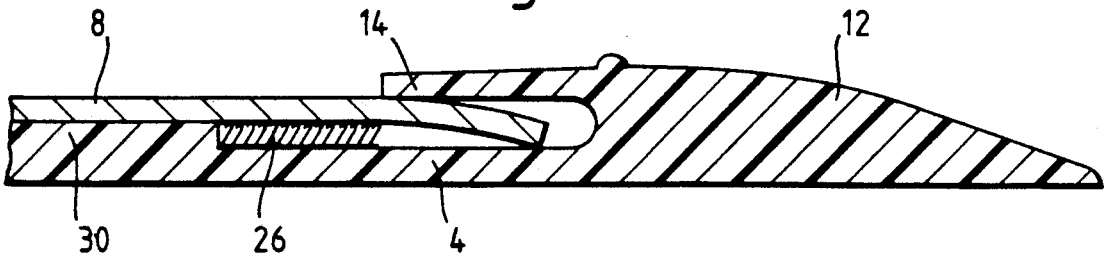
FIG. 11 is a sectional view of part of an alternative form of the holder of FIG. 9.

Another embodiment of the holder is shown in FIGS. 9 to 11. In this case strips of 'Klettostop' 26 are provided adjacent the edges of the recess and integral lips 14 are also provided. Again either of these holding means could be used separately but their combined use gives greater protection against slipping. A pad of resilient material 28 or 30 is provided in the recess which abuts the 'Klettostop' strips 26. This may be a separate pad 28 (FIG. 10) or a pad 30 integrally formed with the base 4 (FIG. 11). The pad has a thickness equal to the height of the velcro® strips 26 and therefore ensures that the surface of the pad is flat and does not dip in the middle. Furthermore the pad makes the mat more comfortable to walk on.

Figure 12:
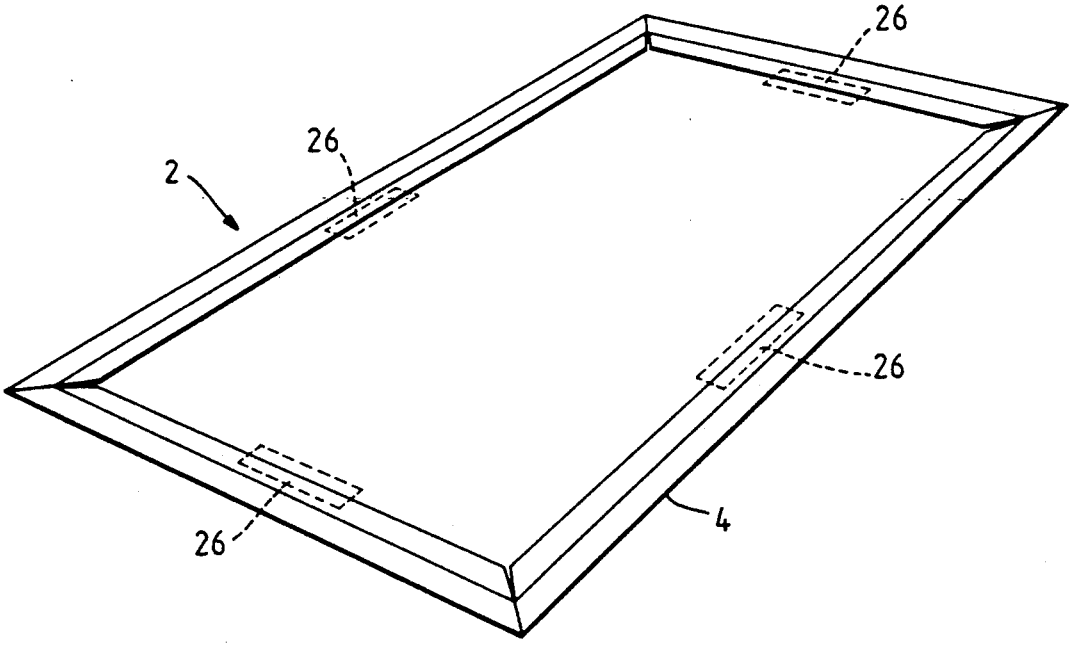
FIG. 12 is a plan view of another embodiment of a holder.
Figure 13:
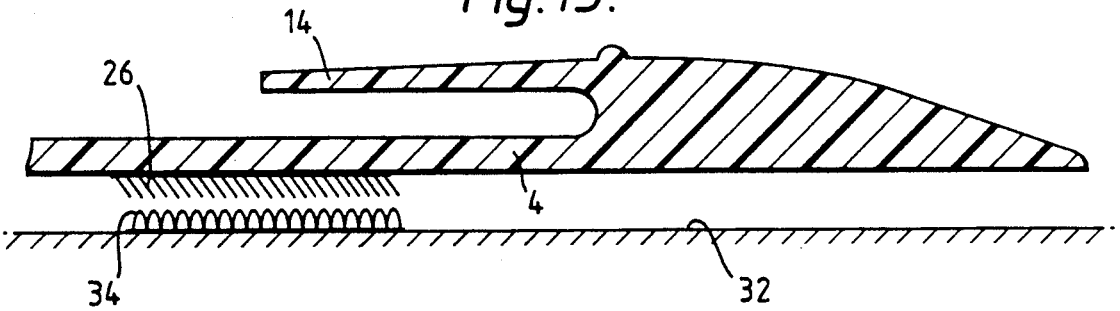
FIG. 13 is a section through part of the holder of FIG. 12.
Figure 14:
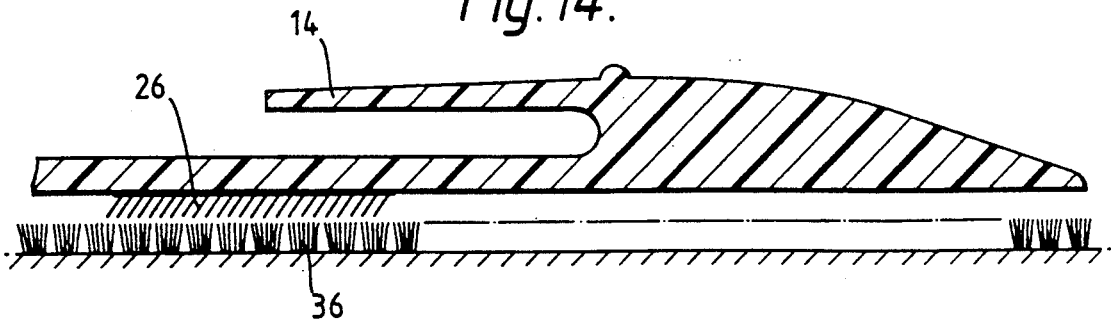
FIG. 14 is a section through part of an alternative form of the holder of FIG. 12.

In the embodiment shown in FIGS. 12 to 14 the base 4 has four "Klettostop" male strips 26 attached by adhesive to the underside of the base 4. If the holder is to be placed on a smooth support surface 32 (see FIG. 13) four correspondingly positioned female "Klettostop"

strips 34 are attached to this. The hooks or spikes in the male strips 26 lock into the loops on the female strips 34 to retain the holder in the desired position on the support surface. If the holder is to be placed on a carpeted surface or other fibrous covering 36, the male strips 26 act alone, locking with the fibers, to retain the holder in place. The mat may be held on the holder by any of the ways described above.

The holders described above are cheap to manufacture, obviate the need for a backing layer for a mat and hold any type of flexible material in place. Furthermore they may themselves be held in place on any type of surface.

We claim:

1. A holder for a flexible mat, said holder comprising a base upon which the mat rests, said base having corners and an integral upwardly extending wall about its periphery, said wall having an integral lip with a tapered edge forming a recess channel dimensioned so as to receive edge portions of a correspondingly shaped mat, said wall having raised ridge means provided on the upper surface of the wall extending around the holder and in vertical alignment with the edge of said recess to act as a guide for correct placement of said mat in the holder, means to hold the edge portion of the mat in place, and slits provided within the lip from the free edge of the lip to said upwardly extended wall to facilitate placement of the mat material within said channel.

2. A holder as claimed in claim 1 wherein a layer of resilient material is provided between the flexible material and the base.

3. A holder as claimed in any preceding claim wherein the base on which the mat rests includes means for releasably attaching a fibrous portion of the flexible material of the mat, thereto.

4. A holder as claimed in claim 3 wherein the releasable attaching means comprises a plurality of upwardly extending hooks or spikes formed from a plastic material.

5. A holder as claimed in claim 4 wherein strips of the attaching means are provided adjacent to the wall of the holder and the hooks or spikes are arranged to slant towards the outside edge of the holder.

6. A holder as claimed in claim 1 including means for retaining the holder in place on a support surface.

7. A holder as claimed in claim 6 wherein the retaining means comprises at least one holding means, one side of which can be secured to the base of the holder and the other side of which is removably attachable to a fibrous surface.

8. A holder as claimed in claim 1, wherein the holder is made of rubber or a rubber-like substitute.

* * * * *